United States Patent [19]

Silverman

[11] Patent Number: 4,683,587

[45] Date of Patent: Jul. 28, 1987

[54] SUBMERSIBLE PERSONAL STEREO

[76] Inventor: Michael D. Silverman, 16410 Calahan St., Sepulveda, Calif. 91343

[21] Appl. No.: 743,385

[22] Filed: Jun. 11, 1985

[51] Int. Cl.[4] ..... H04R 5/00

[52] U.S. Cl. ..... 381/25; 381/74; 181/22; 181/129; 181/131; 367/131

[58] Field of Search ..... 367/132, 134, 131; 181/20, 22, 129, 131; 381/25, 74, 87, 88

[56] References Cited

U.S. PATENT DOCUMENTS

| | | | |
|---|---|---|---|
| 2,573,438 | 10/1951 | Hathaway et al. . | |
| 3,217,831 | 11/1965 | Scanlon | 381/25 |
| 3,547,219 | 12/1970 | Bothos | 181/135 |
| 3,826,987 | 7/1974 | Stevens | 325/361 |
| 3,851,123 | 11/1974 | Lipinski et al. | 325/361 X |
| 3,906,170 | 9/1975 | Guice . | |
| 4,118,606 | 10/1978 | Larkin | 181/20 |
| 4,456,797 | 6/1984 | Olsen . | |
| 4,565,258 | 1/1986 | Butler et al. | 181/129 |

*Primary Examiner*—Forester W. Isen
*Attorney, Agent, or Firm*—Lewis Anten

[57] ABSTRACT

Submersible personal stereo using a source, such as a radio, of stereo signals, a pair of sealed chambers housing a pair of electro-acoustic transducer and acoustic transmissive tubing for transmitting sound from the chambers to ear plugs, the tubing being non-wet by water and of a small inner diameter to keep water from entering.

12 Claims, 5 Drawing Figures

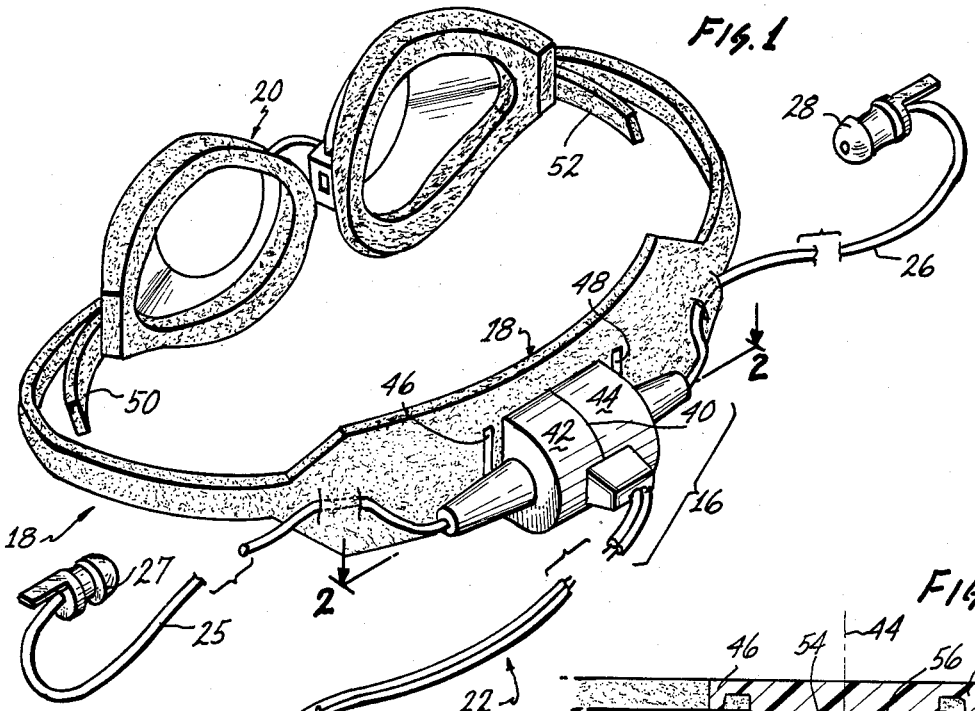
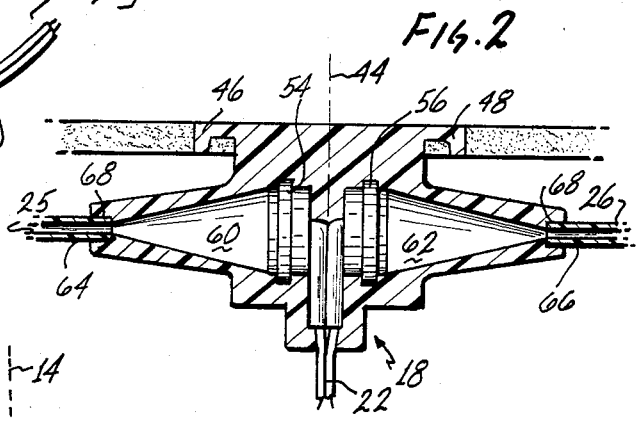
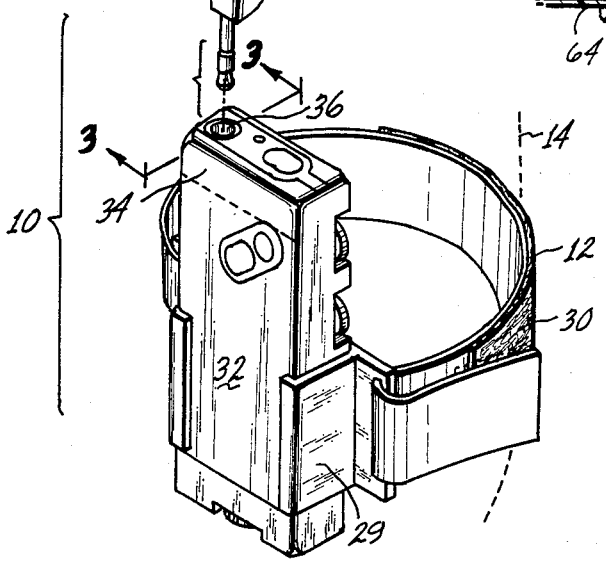
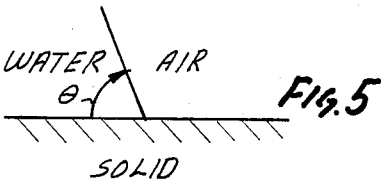
Fig. 5
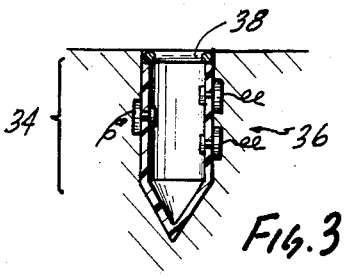
Fig. 3
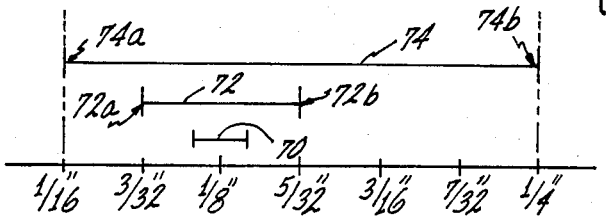
Fig. 4

SUBMERSIBLE PERSONAL STEREO

BACKGROUND OF THE INVENTION

The present invention relates to headphones for personal stereo players and more particularly to a submersible headphone system for adapting such players to use while participating in water sports such as swimming, surfing and sailing.

Heretofore, general systems for this purpose have been known from U.S. Pat. No. 4,456,797 to Eric Olsen. In U.S. Pat. No. 4,456,797 an electrical circuit is established to earphones having an outer member in the form of a cup placed over the ear. A metal diaphram inside the transducer produces acoustical energy and also serves as a water barrier. Otherwise, the unit is air-coupled. The system suffers from several disadvantages including poor fidelity resulting from sound transmission throughout the metal diaphram and a want of sufficient waterproofing. The latter results from placing the transducer at a position of high activity at the ear and from a construction which is inherently susceptible to leakage. Moisture resistant radios have been known for some time and is for example available from Sony Corporation under the designation SRF-5, the Sports FM Walkman (trademark of Sony Corporation). While the receiver of the SRF-5 Sony product is quite satisfactory, the implementation of the earphones in a totally waterproof manner had not been achieved. Sony advises that the unit is not to be immersed and indeed immersion of the earphones will ruin them.

There is, therefore, a need for an improved personal stereo device with headphones which can be submersed.

OBJECTS AND SUMMARY OF THE INVENTION

In general, it is an object of the present invention to provide a submersible stereo.

A further object of the invention is to provide a submersible personal stereo which uses a pair of dynamic electro-acoustic transducers sealed to prevent the encroachment and damage by water.

A further object of the invention is to provide a submersible personal stereo of the above character which the earphones are mounted for being supported away from the ears to keep them out of position of high activity and also to promote comfort.

A further object of the invention is to provide a submersible personal stereo of the above character which achieves the foregoing objects while having a pleasant, high fidelity performance.

In accordance with the present invention a pair of high fidelity electro-acoustic transducers are mounted preferably intermediate the radio or player and the ears such as on a headband. The mounting includes chambers which are conically shaped to converge into hollow tubing extending into and terminating in hollow ear plugs such that the inner continuity of the tubing walls continues unbroken to the ears. The inside dimension of the tubing is found to be appropriate when made sufficiently small that entry of water is essentially prohibited by a combination of the high contact angle provided by the tubing materials, surface tension of water and internal air pressure while nevertheless being sufficiently large to permit passage of high fidelity sound waves.

These and other features and objects of the invention will become apparent from the following description and claims when taken in conjunction with the accompanying drawings, of which:

BRIEF DESCRIPTION OF THE DRAWINGS

FIG. 1 is a perspective view of a submersible personal stereo player and earphone system constructed in accordance with the present invention.

FIG. 2 is a cross-sectional view of the system of the invention taken along the lines 2—2 of FIG. 1.

FIG. 3 is a cross-sectional view of the system of the present invention taken along the lines 3—3 of FIG. 1 and showing particularly the waterproofing of the mini-jack and plug assembly.

FIG. 4 shows a set of graphs which illustrate operable ranges of tubing sizes for use in the present invention.

FIG. 5 is a graph depicting the definition of contact angle $\theta$.

DETAILED DESCRIPTION OF THE PREFERRED EMBODIMENT

Referring particularly to FIG. 1, the submersible personal stereo system of the present invention is shown and generally includes a portable stereo player 10, such as a stereo FM receiver, mounted by a strap 12 on the wearer's arm 14. Electro-acoustical transducers housed in a block 16 are carried on the rear of a headband 18 such as is provided on swimming goggles 20. The transducers are electrically connected to the player 10 by waterproof stereo wire pair 22 terminating at the player end in a stereo mini-jack 24. The acoustic output of the transducers is carried to the ears by a pair of hollow flexible tubes 25,26 terminating in hollow ear plugs 27,28. The details of these structures will now be given.

The player 10 may be mounted in a bracket 29 which is secured about the user's arm with a Velcro (trademark) fastener section 30 which overlaps at one side to provide for adjustment. In one form, in which the player 10 is a radio, it includes a lower section 32 which is completely waterproof and an upper section which is sealed from the lower section and in which a stereo mini-jack 36 is installed for receiving the mini-plug 24. As shown particularly in FIG. 3 the mini-jack is preferably equipped at its entrance with an O-ring seal 38 for keeping water out when the jack is engaged by a mini stereo plug. Except for the addition of the O-ring seal 38, the player waterproofing construction just described is available at present in the Sony Sports FM Walkman SRF-5 stereo radio.

In accordance with the invention the output of the player is transmitted by the electrical wiring pair 22 to the transducer block 16, the construction of which will now be described.

Referring now particularly to FIG. 2, the transducer housing or block is shown in detail in cross-sectional view and comprises a block of waterproof material, such as plastic, symmetrically constructed about a center line at 40 to form left and right halves 42,44. Each half includes an ear 46 which extends as an extension of the body of the housing and loops through the headband into slots 46,48 in the band for removably securing the housing in position. Since headbands do not come with adequate mounting facilities in this respect, it will be necessary to provide a special headband having the features of a rear support section of extended width and slots for receiving and supporting the transducer housing. However, such bands generally terminate at the front end at flaps 50,52 which thread retainers (not shown) of the goggles themselves and these members are sufficiently standard that a few sizes of headband constructed in accordance with the present invention should be adequate as replacement gear with most available goggles.

The housing may, if plastic, be cast around electro-acoustic transducer 54,56 and holds them back-to-back within the housing in a rigid and secure manner. Each side of the housing is formed to provide tappered, frustro-conical chamber 60,62 which extends from a cross-section substantially equal to that of the respective transducer substantially equal to it down to a much smaller cross-section, approximately equal to the tubing section 25,26 to which it is joined. The transducers may be of typical construction for converting electrical energy into acoustical energy such as may be taken, for example, from Sony Stereo Dynamic Earphones MDR-E232K. Such earphones have the following electrical specifications: Dynamic; Drivers have 16 mm diaphram, dome type; Impedence 16 ohms at 1 kHz Sensitivity 108 dB/mW; Frequency response 20–20,000 cycles.

The transducer housing 16 may be made of any clear casting resin which can be catalyzed to set as a solid. Standard Brands (trademark) A-1 Clear Casting Resin (polyester) and Catalyst have been satisfactorily used. It will be appreciated that the housing, if plastic, may be made of any impact resistant molded plastic material.

At the outlet of each of the conical housing sections 60,62 tapers into respective ends 64,66 of sections of tubing to which it is joined with any of several types of cement or bonding material such as clear silicone rubber cement at 68 such as that sold by General Electric Company as silicone rubber caulk.

Each of the frustro-conical chambers 60,62 serves as an acoustical transformer for concentrating and focusing the acoustical energy from across the entire width and face of each of the transducers down into a very small diameter approximately that of the interior diameter of the tubing to be described. By using a frustro-conical transformer shape it is found that the mismatches and reflections due to internal steps and other discontinuities are eliminated and the clarity and coherence of the sound waves is maintained right into the tubing sections. Thus, while the construction is quite simple it is remarkably effective in producing an enhanced and audibly excellent result.

Each section of tubing 25,26 connects each of the small ends of each of the transducer housings and the output of the transformers to ear plugs 32,34. The ear plugs may be of conventional construction having a hollow bore right through the middle to which the tubing is connected and extends in continuity right through.

The tubing is importantly made of a material having particular internal diameter and wetting characteristics which maintains the function of transmitting sound while not admitting water. Thus, the wetting characteristics of the tubing with respect to water, chlorinated water and sea water is of critical importance in the present invention. Generally, swimming waters such as mentioned above have roughly equivalent wetting characteristics for these purposes. A tubing suitable for use in the present invention will be essentially non-wettable as possible with respect to these waters. The wetting property is usually measured by $\theta$, the angle of incidence of water-to-air boundary lying on the surface of the material being considered and illustrated diagramatically in FIG. 5.

Typically this angle of incidence is measured as the advancing angle thereof, and, when nearly zero, represents a substrate material which is highly wet. In the case of water, known materials which are relatively easily wet by water include glass and gold. On the other hand, many polymeric materials including many in the most common plastics are constituted of molecular chains having a high percentage of non-polar groups chiefly made of molecular constituents containing hydrocarbon side chains and linkages, all of which exhibit a substantially non-polar character resulting in and a correspondingly high value of $\theta$, and are not wet by water. A large number of such non-polar polymers exhibit contact angles of at least 90 degrees or greater. These are substantially non-wet by water. These latter materials are the preferred materials for use as tubing in the present invention although any material which is preferably flexible and has a contact angle of 90 degrees or greater may be used. This is to be taken in contrast to that other large body of polymeric materials which have significant polar character and, since water itself is highly polar, such polar plastics are more easily wet by water, can absorb water and are less desirable for use in the present invention.

Examples of suitable plastic materials for use as tubing with the present invention include polyethylene, polypropylene, diene polymers, polystyrene, acrylonitrile-butadiene-styrene terpolymers, nylon, polyesters, polyurethanes.

It is important that the tubing exhibit capillary depression. By this is meant that for tubings of the preferred materials having high contact angles, it will be impossible for a drop of such waters to enter them if they are sufficiently small.

In accordance with the present invention it has been found that it is possible to achieve two criteria in the same construction, namely that the inner diameter be sufficiently small such that capillary action and surface tension as related to the contact angle, coupled with the maintenance of internal air pressure will prohibit the entry of water; while at same time being sufficiently large, that satisfactory transmission of acoustical energy through the air within the tubing can take place. Thus, immersion of the tubing ends and ear plugs in water will not result in entry of water into the tubing; while placing the capillary tubing and ear plugs into the ears will result in very satisfactory and high fidelity reproduction of sound at the ear plugs.

With respect to the inner dimension of the tubing it has been found that an inner dimension of 0.060 inches is too small to allow high fidelity sound transmission while an inner diameter of 0.09 inches has been found to produce satisfactory results. The inner diameter may be increased but as will be appreciated, even capillary action has its limits and an increase of about 0.10 inches does not result in sufficient audio improvement to warrant the additional ease with which water may be forced into such larger dimension tubing. More specifically, the operable range of sizes in accordance with the present invention for the tubing interconnect between the transducer housing and the ear plug at the minimum is 0.09 inches, at the maximum 0.16 inches and is preferred approximately at 0.13 inches for a flexible, solid polyurethane tubing.

FIG. 4 summarizes the operable and preferred ranges of sizes for use in the present invention for polyurethane tubing. In general, it has been found for materials having a contact angle of about 90 degrees or greater, that a tubing size right about one-eighth of an inch, as at 70, is preferred while the range indicated at 72 is limited at the small end 72*a* by loss in sound transmission, notwithstanding excellent water rejection and at the large end 72*b* by questionable results in water rejection irrespective of fine sound transmission. It is also established that the outer limits of tubing inner diameters for use in the invention appear to be given by the range 74, the lower end 74*a* at one-sixteenth of an inch representing unacceptably poor sound transmission. While the upper end at 74*b* (one-quarter of a inch) represents failure of water exclusion.

It should be emphasized that the construction calls for the housing to be airtight so that the tube is essentially sealed at the transducer end, and presents an ideal gas law resistance to water entry as a column, in accordance with the increase in pressure due to gas compression (from the gas law, $P=nRT$; $dP=-nRT\ dv$). Accordingly, water should bead in the selected tubing material in a drop large enough to effectively block the opening of the tube (with the assistance of the contained air) and for such an interrelation of water, tubing material and diameter, the meniscus of air, the entering drop of water will be prevented from traveling towards the closed end of the tube. For wettable materials the required diameter may be too small for effective sound transmission.

To those skilled in the art to which this invention pertains, many modifications and adaptations will occur without departing from the spirit and scope thereof. For example, the entire length of the tubing sections need not be made of the same material or of the same dimension. It is sufficient that an effective length of the tubing satisfy the above criteria at ear plug.

While I have shown an O-ring seal as added to the receiver, as shown in FIG. 3, it will be obvious to those skilled in the art that the O-ring seal may be fit into a circumferential groove at the base of the pin of plug 24. Accordingly, the scope of the present invention should not be limited by the specific example given, but should solely be taken from the scope of the appended claims.

What is claimed is:

1. Portable waterproof stereo sound headphone system for use with a source of electronic signals having means for attachment to the user, comprising at least two transducers for converting electrical signals to sound signals, a transducer housing having a pair of separate sound chambers, said transducers being mounted in said chambers, waterproof electrical signal transmission means for connecting the transducers to said signal source, means for attaching the housing to the user, left and right air transmission lines for transmitting sound, each of said lines including a section of tubing connected at one end to respective one of said chambers and sealed in air tight relation to said housing so that said chambers and associated tubing represents an air tight volume containing a column of air extending end-to-end to said tubing, a pair of earplugs each having a hole therein and attached to the other end of the respective tubing section so that sound passes through said tubing section and earplug to the ear of the wearer, said tubing and earplugs having an inside diameter large enough to pass sound with fidelity, but small enough to impede entrance of water by a combination of capillary action in relation to the surface tension and contact angle of water, together with compression resistance of the sealed column of air contained within each of said sealed tubing and chamber volumes.

2. The headphone as in claim 1 further in which said tubing has an inside diameter from about 0.09 inches to 0.16 inches.

3. The headphone system as in claim 1 in which said tubing has an inside diameter from about one-sixteenth inches to about one-quarter inches.

4. A headphone as in claim 1 in which said tubing is made of a non-polar plastic.

5. The headphone system as in claim 4 in which said plastic is selected from the group including polyethylene, polypropylene, diene polymers, polystyrene, ABS terpolymers, nylon, polyesters, and polyurethanes.

6. A headphone system as in claim 1 in which said housing includes means forming left and right sound chambers each having a diameter at one end of the same size as the transducer, the transducer being mounted to that end, and diameter at an end opposite from the transducer equal to the diameter of the tubing, and walls forming a frustro-conical chamber between said transducer end and said tubing end.

7. The headphone system as in claim 1 in which said means for attaching the housing to the user includes a band for being worn by the user, and further including means associated with said housing and said band for coupling the housing to the band for support thereof.

8. The headphone system as in claim 1 in which said housing is partitioned with separate compartments for each transducer, each compartment having a tapering transmission section associated therewith the larger end of which is proximate the transducer for receiving the output thereof, and the smaller end being spaced away from the transducer.

9. A waterproof headphone system as in claim 1 further including a tapered transmission section interposed between the transducer section and the tubing transmission line, said transmission section having a generally frustro-conical shape, the input end being constructed approximately the same area as the transducer and the output end being approximately the same size as the diameter of the tubing.

10. The headphone system as in claim 1 wherein said tubes are made of a polymeric material which is flexible.

11. The headphone system as in claim 1 wherein said tubing is made of solid, flexible polyurethane plastic.

12. Portable waterproof sound headphone system for use with a source of electronic signals having means for attachment to the user and comprising:

1. at least one transducer for converting electrical signals to sound signals,
2. a transducer housing having at least one sound chamber, said transducer being mounted in said chamber,
3. waterproof electrical signal transmission means for connecting the transducers to said signal source and including means for attaching the housing to the user,
4. at least one air transmission line for transmitting sound, said line including a section of tubing connected to said chamber and sealed in air tight relation to said housing so that said chamber and associated tubing represents an air tight volume containing a column of air, 5. at least one earplug having a hole therein and attached to said tubing section so that sound passes through said tubing section and earplug to the ear of the wearer,
6. said tubing and earplugs having an inside diameter large enough to pass sound with fidelity, but small enough to impede entrance of water by a combination of capillary action in relation to the surface tension and contact angle of water, and compression resistance of the sealed column of air contained within said sealed tubing and chamber volume.

* * * * *